US010130175B2

(12) United States Patent
Christian

(10) Patent No.: US 10,130,175 B2
(45) Date of Patent: Nov. 20, 2018

(54) WHEEL-MOUNTED CARPET PROTECTOR

(71) Applicant: Robert N. Christian, Canonsburg, PA (US)

(72) Inventor: Robert N. Christian, Canonsburg, PA (US)

( * ) Notice: Subject to any disclaimer, the term of this patent is extended or adjusted under 35 U.S.C. 154(b) by 0 days.

(21) Appl. No.: 15/448,790

(22) Filed: Mar. 3, 2017

(65) Prior Publication Data

US 2017/0290427 A1 Oct. 12, 2017

Related U.S. Application Data

(60) Provisional application No. 62/320,015, filed on Apr. 8, 2016.

(51) Int. Cl.
*A47B 91/06* (2006.01)
*A47B 91/12* (2006.01)

(52) U.S. Cl.
CPC ..... *A47B 91/12* (2013.01)

(58) Field of Classification Search
CPC ..... A47B 91/00; A47B 91/02; A47B 91/12; A47B 91/14; A47B 91/16; A47B 91/06; A47B 2091/063; B60B 33/00; B60B 2033/0034; B60B 2900/5112; B65G 7/02; A47C 7/002; A47C 7/008; A61H 3/0288; A61H 3/068; Y10T 16/207; Y10T 16/209; Y10T 16/211; Y10T 16/21; Y10T 16/216
See application file for complete search history.

(56) References Cited

U.S. PATENT DOCUMENTS 1,451,999 A * 4/1923 Perry ..... A47B 91/024 16/19
1,861,095 A * 5/1932 Schacht ..... A47B 91/12 16/42 R
1,903,690 A * 4/1933 Schacht ..... A47B 91/12 248/346.11
1,982,138 A 11/1934 Herold
2,787,085 A * 4/1957 Auer ..... A47B 91/12 248/346.11
2,902,794 A 9/1959 Ehrgott
5,081,740 A 1/1992 Smith
5,210,903 A * 5/1993 Horning ..... B60B 33/00 16/18 R (Continued)

FOREIGN PATENT DOCUMENTS

JP 08171385 A * 7/1996

*Primary Examiner* — Chuck Y Mah
(74) *Attorney, Agent, or Firm* — Global Intellectual Property Agency, LLC; Daniel Boudwin

(57) ABSTRACT

A wheel-mounted carpet protector configured to receive a wheel. The wheel-mounted carpet protector includes a housing which includes a base and a sidewall. The base includes an upper surface and a lower surface. The sidewall includes an inner surface. The upper surface of the base and the inner surface of the sidewall define a cavity, wherein the cavity receives a wheel of a furniture leg. The lower surface of the base slidably engages with a carpet such that the wheeled furniture is capable of freely sliding across the carpet without damaging the carpet. In some embodiments, the cavity includes a channel that the wheel rests on such that the wheel is centered within the wheel-mounted carpet protector to provide an even distribution of force along the lower surface of the base.

7 Claims, 2 Drawing Sheets

(56) References Cited

U.S. PATENT DOCUMENTS

| | | | | |
|---|---|---|---|---|
| 5,782,444 | A * | 7/1998 | Anderman | A47B 91/06 248/188.4 |
| 8,438,701 | B2 | 5/2013 | Bushey | |
| 8,621,710 | B2 * | 1/2014 | Carpinella | A47B 91/06 16/42 R |
| 2003/0042727 | A1 | 3/2003 | Khubani | |
| 2004/0123421 | A1 * | 7/2004 | Bushey | A47B 91/06 16/17.1 |
| 2005/0034268 | A1 * | 2/2005 | Wurdack | A47B 91/002 16/42 R |
| 2005/0115022 | A1 * | 6/2005 | Desmarais | A47B 91/066 16/42 R |
| 2005/0183234 | A1 * | 8/2005 | Bushey | A47B 91/06 16/42 R |
| 2010/0050389 | A1 * | 3/2010 | Robinson | A47B 91/06 16/42 R |
| 2012/0291829 | A1 * | 11/2012 | Albury | A61H 3/0288 135/77 |
| 2014/0138509 | A1 | 5/2014 | Lehman | |

* cited by examiner

WHEEL-MOUNTED CARPET PROTECTOR

CROSS REFERENCE TO RELATED APPLICATION

This application claims the benefit of U.S. Provisional Application No. 62/320,015 filed on Apr. 8, 2016. The above identified patent application is herein incorporated by reference in its entirety to provide continuity of disclosure.

BACKGROUND OF THE INVENTION

Field of the Invention

The present invention relates to carpet protectors. More specifically, the present invention provides a wheel-mounted carpet protector configured to receive a wheel.

Carpet protectors are often used under the legs of a piece of furniture to act as a barrier between the leg piece of furniture and the floor on which the piece of furniture rests. Over the years many carpet protectors have been proposed for supporting various legged articles, such as articles of furniture, over a floor so that the article of furniture will not damage the floor or prevent the furniture from being slidably displaced. Typically, the carpet protector is a plastic or rubberized mat that is position between the furniture leg and the floor, wherein the weight of the furniture is dispersed over the larger surface area of the mat, preventing scratching, flattening, or other damaging of the floor when the piece of furniture is moved or left for a significant period of time.

Devices have been disclosed in the known art that relate to carpet protectors. These devices in the known have several known drawbacks. For example, some of these devices simply rest on the floor and are not attached to the legs of the article of furniture, and rely on the placement of the device alone to designate a limited protected area. Additionally, mats can be bulky, heavy, and cumbersome and must be moved in order to protect a larger floor space. Furthermore, while being moved, the furniture can slide off of the protector leading to potential damage to the furniture due to sudden shifts in force applied to the furniture legs.

In light of the devices disclosed in the known art, it is submitted that the present invention substantially diverges in design elements from devices in the known art and consequently it is clear that there is a need in the art for an improvement to existing devices. In this regard the instant invention substantially fulfills these needs.

SUMMARY OF THE INVENTION

In view of the foregoing disadvantages inherent in the known types of carpet protectors now present in the art, the present invention provides a new wheel-mounted carpet protector wherein the same can be utilized for providing convenience for the user when resting or moving wheeled furniture on a carpeted area.

It is therefore an object of the present invention to provide a new and improved wheel-mounted carpet protector that prevents damage to carpets when furniture is positioned thereon.

It is another object of the present invention to provide a wheel-mounted carpet protector configured to receive a wheel disposed on a leg of a piece of furniture, wherein a lower surface of the wheel-mounted carpet protector distributes the load of the furniture evenly across the floor surface.

Another object of the present invention is to provide a wheel-mounted carpet protector comprising a semi-rigid material that is configured to deform to a shape corresponding to that of a received wheel, wherein contact between the received wheel and the sidewall is maintained.

Another object of the present invention is to provide a wheel-mounted carpet protector that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
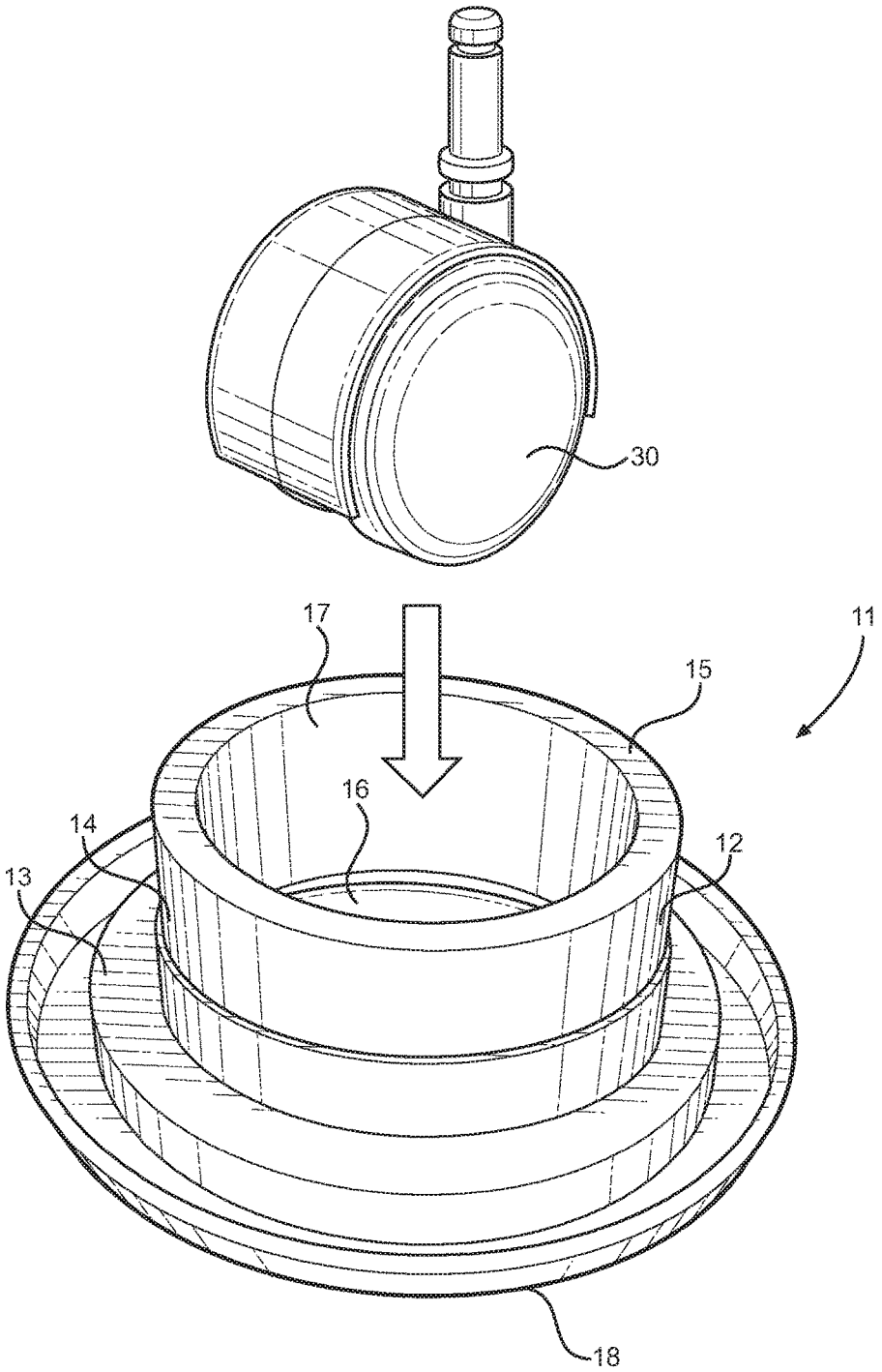
FIG. 1 shows a perspective view of an embodiment of the wheel-mounted carpet protector.

Reference is made herein to the attached drawings. Like reference numerals are used throughout the drawings to depict like or similar elements of the wheel-mounted carpet protector. For the purposes of presenting a brief and clear description of the present invention, the preferred embodiment will be discussed as used for resting or moving wheeled furniture on a carpeted area. The figures are intended for representative purposes only and should not be considered to be limiting in any respect.

Figure 2:
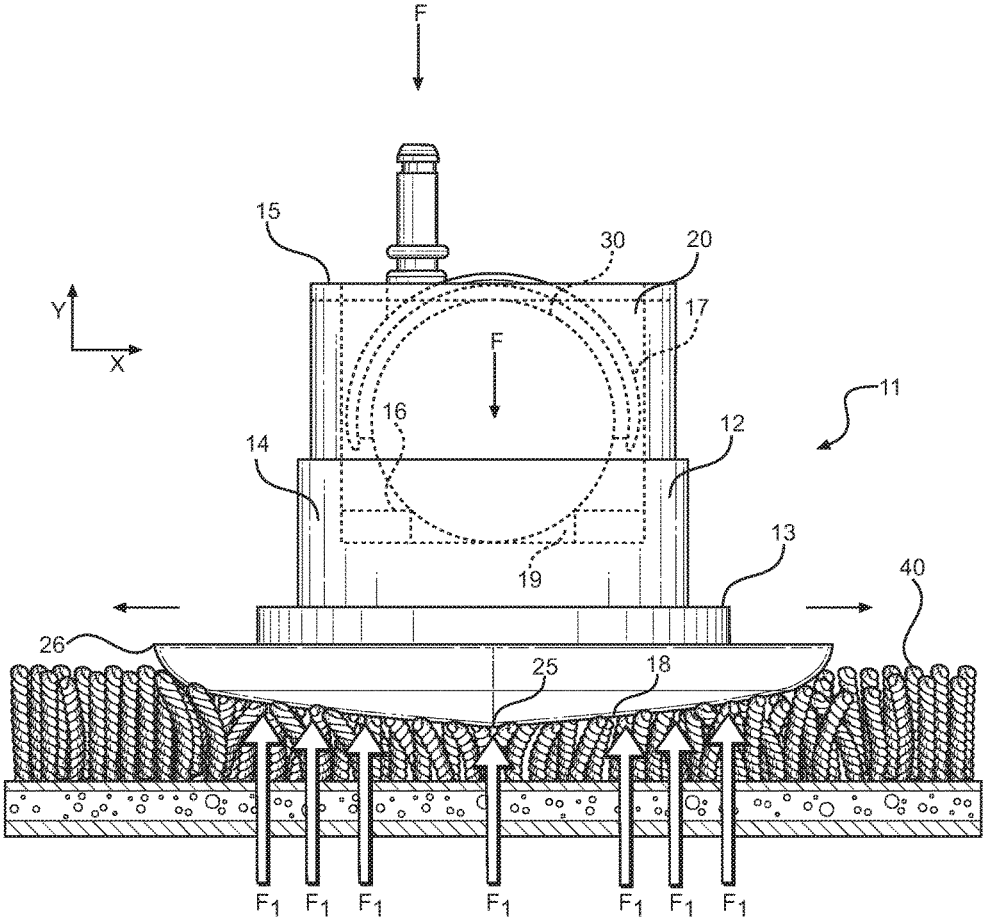
FIG. 2 shows a front view of an embodiment of the wheel-mounted carpet protector in use.

Referring now to FIGS. 1 and 2, there is shown a perspective view of an embodiment of the wheel-mounted carpet protector and a front view of an embodiment of the wheel-mounted carpet protector, respectively. The wheel-mounted carpet protector 11 comprises a housing 12 which includes a base 13 and a sidewall 14 extending from the base 13. The base 13 includes a lower surface 18 and an upper surface 16. The sidewall 14 includes an inner surface 17. The upper surface 16 and the inner surface 17 define a cavity 20, wherein the cavity 20 is configured to receive a wheel 30 of a furniture leg. The lower surface 18 is configured to slidably engage with a carpet 40.

In the illustrated embodiment, the sidewall 14 comprises a semi-rigid material. In this way, the sidewall 14 is configured to deform to correspond with the shape of the wheel 30, such that the wheel 30 is in maintained contact with the sidewall 14. In another embodiment, the sidewall 14 is configured to distribute the force of the wheel 30 evenly across the sidewall 14. In some embodiments, the sidewall 14 is vertical, however in other embodiments, the sidewall 14 is angled from the base 13 up to 45 degrees. In an alternate embodiment, the sidewall 14 is configured such that the height of the sidewall 14 is equal to half of the maximal width of the cavity 20.

In the illustrated embodiment, the lower surface 18 is configured to distribute a force evenly across the lower surface 18 of the base 13. The force is applied by the received wheel 30 along a vertical axis. The even distribution of the force allows the wheel-mounted carpet protector 11 to move easily, while causing minimal damage to the structure of the carpet 40. In the illustrated embodiment, the lower surface 18 is curved between a center point 25 and a perimeter 26, wherein the center point 25 protrudes away from the upper surface 16 such that the protrusion defined about the center point 25 increases as the distance to the perimeter 26 increases. This creates a shape capable of deflecting the carpet 40 in a non-damaging way while evenly distributing the force created along a vertical axis by the received wheel 30. In another embodiment, the lower surface 18 is curved about a center point 25 such that angle of the curve from the center point 25 to the perimeter 26 relative to the base 13 is between 0 and 5 degrees. This allows the carpet 40 to be angled away from the center point 25 at a desirable non-damaging angle.

In the illustrated embodiment, the housing 12 includes a channel 19 disposed within the cavity 20. The channel 19 is configured to receive the wheel 30 partially therein. This allows the wheel 30 to be centered within the housing 12 which allows an even distribution of force along the lower surface 18. In some embodiments, the channel 19 is disposed on the upper surface 16 of the base 13 such that the channel 19 is aligned with a central vertical axis. In other embodiments, the channel 19 is disposed on the inner surface 17 of the sidewall 14 such that the channel 19 is aligned along a horizontal axis.

In use, the wheel 30 of a furniture leg is placed into the cavity 20 of the wheel-mounted carpet protector 11 such that the wheel 30 rests partially within the channel 19. The force produced by the wheel 30 is evenly distributed across the lower surface 18 of the base 13. This allows the lower surface 18 to slidably engage with the carpet 40, angling the engaged carpet away from the center point 25 of the base 13. The even distribution of force across the lower surface 18 allows the wheel-mounted carpet protector 11 to move easily across the carpet 40 while preventing the carpet 40 from becoming damaged.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wheel-mounted carpet protector comprising;

a housing comprising;

a base including a lower surface and upper surface;

a sidewall extending from the base, the sidewall including an inner surface wherein the upper surface of the base and the inner surface of the sidewall define a cavity, the cavity configured to receive a wheel of a furniture leg;

the lower surface of the base is configured for sliding engagement with a carpet;

wherein the lower surface is curved between a center point and a perimeter to form a convex arc, such that the angle of curvature from the center point to the perimeter relative to the base is between 0 and 5 degrees; and wherein the center point protrudes outward and away from the upper surface at a greater distance relative to the perimeter.

2. The wheel-mounted carpet protector of claim 1, wherein;

the housing includes a channel disposed within the cavity, the channel configured to receive a wheel partially therein.

3. The wheel-mounted carpet protector of claim 2, wherein;

the channel is disposed on the upper surface of the base, the channel aligned with a central vertical axis.

4. The wheel-mounted carpet protector of claim 1, wherein;

the sidewall comprises semi-rigid material that is configured to deform to a shape corresponding to that of a received wheel, wherein contact between the received wheel and the sidewall is maintained.

5. The wheel-mounted carpet protector of claim 4, wherein;

the sidewall is configured to distribute a force from a received wheel evenly across the sidewall.

6. The wheel-mounted carpet protector of claim 1, wherein;

the lower surface is configured to distribute a force evenly across the lower surface of the base, wherein the force is applied along a vertical axis from a received wheel.

7. The wheel-mounted carpet protector of claim 1, wherein;

the sidewall is configured such that the height of the sidewall is equal to half of the maximal width of the cavity.

* * * * *